US005226621A

United States Patent [19]

Skoff

[11] Patent Number: 5,226,621

[45] Date of Patent: Jul. 13, 1993

[54] CONVERTIBLE COLLECTION DEVICE AND WORK TABLE COMBINATION

[76] Inventor: James Skoff, 1212 Chestnut St., Oakdale, Pa. 15071

[21] Appl. No.: 930,145

[22] Filed: Aug. 13, 1992

[51] Int. Cl.[5] ..... A63B 55/04

[52] U.S. Cl. ..... 248/97; 108/26

[58] Field of Search ..... 248/97, 98, 99, 95; 269/289 R; 108/14, 15, 26, 159; 144/286; 141/314, 316

[56] References Cited

U.S. PATENT DOCUMENTS

| | | | |
|---|---|---|---|
| 102,616 | 5/1870 | Sweigert . | |
| 316,928 | 4/1885 | Wysong | 108/14 |
| 369,984 | 9/1887 | Elsasser . | |
| 651,773 | 6/1900 | Smith . | |
| 1,298,659 | 4/1919 | Capps | 269/289 X |
| 1,858,793 | 5/1932 | Reynolds . | |
| 2,363,699 | 11/1944 | Smith | 108/25 |
| 3,289,616 | 12/1966 | Donihi | 108/25 X |
| 3,342,226 | 9/1967 | Marcoux et al. | 144/286 |
| 3,402,848 | 9/1968 | Busey | 220/63 |
| 3,556,395 | 1/1971 | Herman | 248/97 X |
| 3,679,160 | 7/1972 | Ballenger | 248/9 |
| 3,948,474 | 4/1976 | Pomroy | 248/99 |
| 4,174,668 | 11/1979 | Thomas | 108/25 |
| 4,236,599 | 12/1980 | Luff et al. | 182/33 |
| 4,273,167 | 6/1981 | Stillwell | 141/314 |
| 4,485,855 | 12/1984 | Dillingham | 141/316 |
| 4,488,697 | 12/1984 | Garvey | 248/101 |
| 4,558,649 | 12/1985 | Maier et al. | 108/159 |
| 4,576,350 | 3/1986 | Bond | 248/97 |
| 4,653,737 | 3/1987 | Haskins | 269/289 X |
| 4,697,771 | 10/1987 | Majors | 248/97 |
| 4,749,158 | 6/1988 | Buckley | 248/98 |
| 4,783,031 | 11/1988 | Ebentheuer | 248/97 |
| 4,869,518 | 9/1989 | Breveglierij | 248/98 X |
| 4,921,193 | 5/1990 | Benesch | 248/97 |
| 4,921,196 | 5/1990 | Rudko | 248/97 |
| 4,927,104 | 5/1990 | Miller | 248/97 |
| 4,946,118 | 8/1990 | Hastings | 248/97 |
| 4,984,758 | 1/1991 | Young | 248/95 |
| 5,016,844 | 5/1991 | Garvin | 248/97 |
| 5,036,893 | 8/1991 | DeCrane | 141/114 |
| 5,048,778 | 9/1991 | Wright | 248/98 |

FOREIGN PATENT DOCUMENTS

| | | | |
|---|---|---|---|
| 196741 | 5/1923 | United Kingdom | 108/25 |

*Primary Examiner*—J. Franklin Foss

*Attorney, Agent, or Firm*—Webb, Burden, Ziesenheim & Webb

[57] ABSTRACT

A portable, convertible collection device and work table combination which includes a frame with a plurality of ribs defining a substantially rectangular interior with two distinct openings. Each opening is adapted to receive a bag supported by the ribs. A plurality of legs supporting the ribs extend adjacent a corner of the rectangular interior. A removable table, which is adapted to be supported by the ribs, includes a table top and a plurality of positioning studs attached to the bottom surface of the table top which are receivable in the rectangular interior to position the table on the ribs. A removable funnel is adapted to be supported on the ribs to direct material into the bags supported from the ribs.

21 Claims, 3 Drawing Sheets

CONVERTIBLE COLLECTION DEVICE AND WORK TABLE COMBINATION

BACKGROUND OF THE INVENTION

1. Field of the Invention

This invention relates to a convertible collection device and work table combination.

2. Prior Art

Work tables and bag holding frames are well-known in the art such as, for disclosed in U.S. Pat. Nos. 102,616; 369,984; 3,342,226 and 4,273,167. However, the prior art has failed to provide a convenient frame quickly adaptable for supporting either a work table or a funnel leading to refuse bags held by the frame while maintaining easy access for removal of the refuse bags. The object of the present invention is to overcome the drawbacks of the prior art.

SUMMARY OF THE INVENTION

The present invention is a portable, convertible collection device and work table combination.

The base of the present invention includes a frame with a plurality of ribs provided to define a substantially rectangular interior. The ribs include a pair of parallel, spaced central ribs which divide the rectangular interior into two distinct openings, with each opening adapted to receive and hold a refuse collecting bag supported by the ribs. The frame includes a plurality of legs supporting the ribs with each leg extending from the ribs adjacent a corner of the rectangular interior.

A removable work table is adapted to be supported on the base, specifically the ribs. The table includes a substantially flat table top and a plurality of positioning studs attached to the bottom surface of the table top. The positioning studs are receivable in the rectangular interior to position the table on the ribs.

A removable funnel is also adapted to be supported on the base, specifically the ribs, to permit the present invention to function as a collection device by directing material into and securing the bag supported by the ribs. The funnel includes a top funnel-shaped portion and a substantially rectangular base.

These and other advantages of the present invention will become more apparent when the preferred embodiments of the present invention are described in accordance with the accompanying figures.

BRIEF DESCRIPTION OF THE PREFERRED EMBODIMENTS

Figure 1:
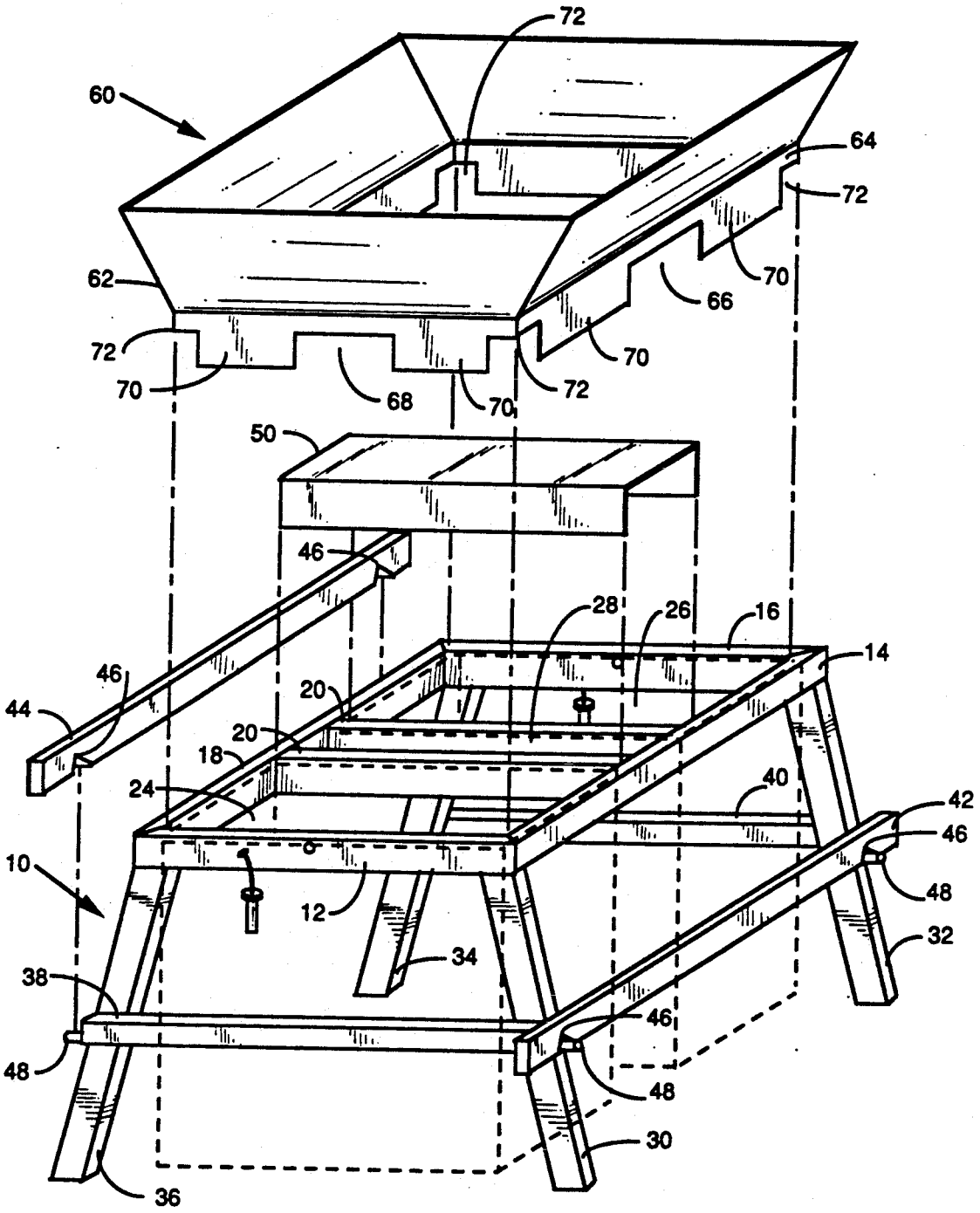
FIG. 1 is a front elevational view of the collection device of the convertible collection device and work table combination of the present invention.

FIG. 1 shows a work table of the present invention which includes a frame 10 for supporting the work table. The frame 10 includes four outer ribs 12, 14, 16 and 18 which define a rectangular interior. A pair of parallel, spaced central ribs 20 extend between outer rib 18 and outer rib 14. The central ribs 20 divide the rectangular interior into two openings 24 and 26 and a slot 28 positioned between the central ribs 20.

Each opening 24 and 26 is adapted to receive a bag (shown in phantom) which is supported by the ribs which surround the opening.

Four legs 30, 32, 34 and 36 extend from and support the ribs, with each leg extending from a corner of the rectangular interior. The legs are angled away from each adjacent leg in a direction extending away from the ribs, defining a generally frusto-pyramidal shape therebetween. This configuration of the legs allows easy access to the bags.

A first support 38 extends between leg 36 and leg 30 and a second support 40 extends between leg 32 and leg 34. These supports serve to stabilize and reinforce the frame 10. Quick release supports 42 and 44 extend between legs 30 and 32 and legs 34 and 36, respectively. Each quick release support includes a pair of notches 46. The notches 46 engage support pegs 48 provided in the legs. The peg and notch system allows for the quick release of the supports 42 and 44 allowing quick access to, and easy removal of, the bags supported in the frame member, and still provides support for the legs.

A removable clamping channel 50 may be utilized to further secure the bags on the central ribs 20. The U-shaped clamping channel 50 is engagable with the pair of central ribs 20 to secure the bags supported by the ribs between the ribs and the clamping channel 50.

A removable funnel 60 is adapted to be supported on the ribs of the frame 10. The funnel 60 will serve to direct material into the bags supported by the ribs and will also function to secure the bags. The funnel 60 includes a top funnel-shaped portion 62, which includes a plurality of converging side portions defining a generally funnel-shaped structure. The top portion 62 is connected to a base 64 which has a shape substantially equivalent to the shape of the rectangular interior formed by the outer ribs 12, 14, 16 and 18. The base portion 64 is provided with a pair of opposed central cutouts 66. The central cutouts 66 receive the central ribs 20 when the funnel 60 is positioned on the frame 10. The clamping channel 50 may be formed integrally with the funnel 60 and would be positioned above central cutouts 66.

If the rectangular interior is a square configuration, then a second pair of central cutouts 68 may be provided in the base 64. The central cutouts 68 are also adapted to receive the central ribs 20 when the funnel 60 is positioned on the frame 10 at a position 90° from that shown in FIG. 1. The provision of two pairs of central cutouts 66 and 68 allows for the funnel to be placed on the frame at any specific orientation without aligning a single pair of central cutouts with the central ribs.

A plurality of projections 70 are provided on the base 64. The projections 70 extend into the interior of the bags supported by the frame 10. The projections 70 extend into the bag to help keep the bag open during use and also support the bag on the ribs in the frame 10.

Corner cutouts 72 may be provided in the corners of the base 64. The corner cutouts 72 provide for sufficient clearance in the frame 10 to accommodate corner supports (not shown). Corner supports could be added between adjacent outer ribs to further support the frame 10, if needed.

Figure 2:
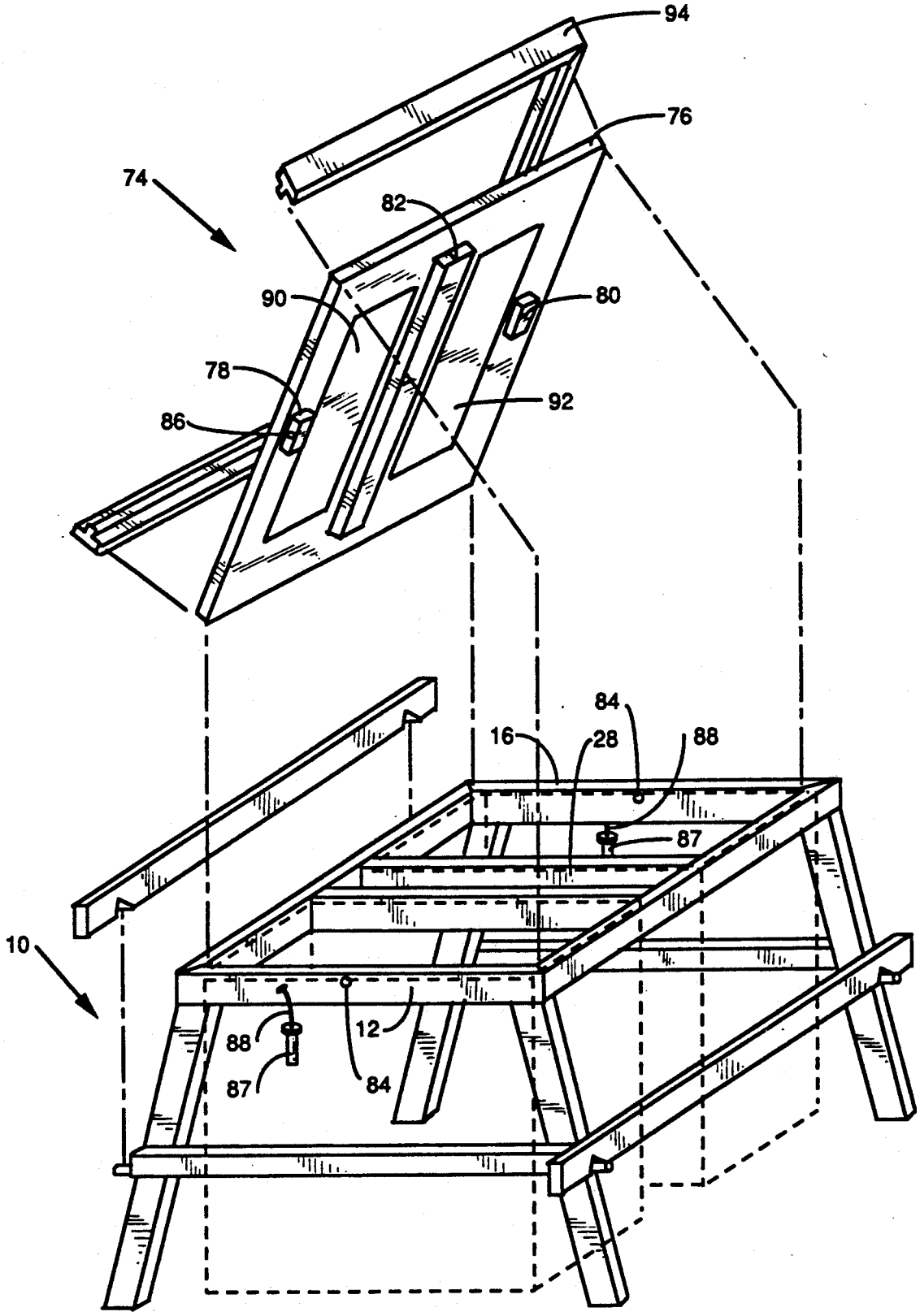
FIG. 2 is a front elevational view of the present invention showing the work table.

FIG. 2 illustrates a table 74 which is adapted to be supported on the ribs of the frame 10. The table 74 includes a substantially flat table top 76 which sits on top of the ribs of the frame 10. Two positioning studs 78 and 80 are attached to the bottom surface of the table top 76 and are receivable within the rectangular interior at a position closely adjacent to the outer ribs 12 and 16 to position the table 74 on the ribs. A central positioning stud 82 is attached to the bottom surface of the table top 76 and is substantially the same size as the slot 28. The central positioning stud 82 is adapted to be receivable within the slot 2 to further secure the table top 76 on the frame 10. A hole 84 can be provided through outer rib 12 and/or outer rib 16, respectively. Each hole 84 aligns with a locking hole 86 provided in the positioning studs 78 and 80 when the table 74 is supported on the frame 10. One or more locking pins 87 is adapted to extend through the hole 84 provided in the outer rib (12 or 16) and is receivable in the respective locking hole 86 on the positioning stud (78 or 80). The locking pin 87 serves to securely fasten the table 74 to the frame 10. A chain 88 may be utilized to secure the locking pin 87 to the appropriate outer rib (12 or 16). The use of the chain 88 will keep the locking pin 87 from being lost when not in use.

The table top 76 may be provided with a plurality of access doors 90 and 92 which extend through the table top 76. The access doors 90 and 92 provide access to the bags supported by the frame 10.

A rim 94 may be provided on the table top 76 such that it extends above and around the peripheral portion of three sides of the table top 76. The rim 94 will serve to contain workpieces on the top surface of the table top 76. The rim 94 will be particularly useful when working with small work pieces such as nuts, bolts, bearings, washers, screws, etc.

Figure 3:
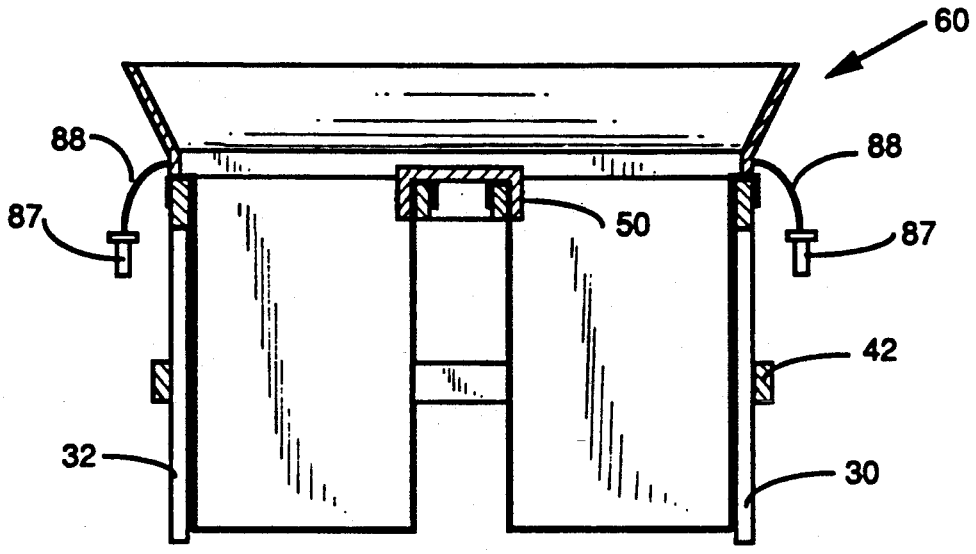
FIG. 3 is a front view of the present invention showing the collection device.
Figure 4:
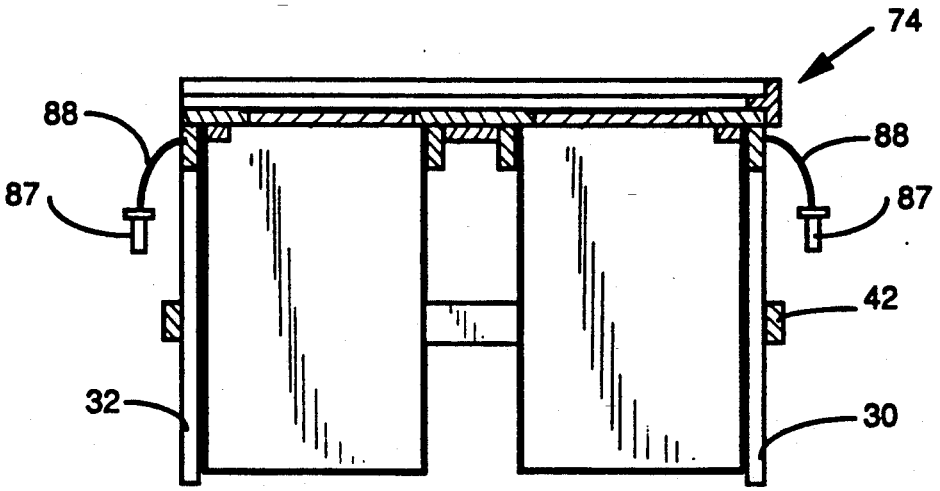
FIG. 4 is a front view of the present invention showing the work table.

In operation, as shown in FIG. 4, the work table of the present invention may be utilized indoors or out with two refuse collecting bags supported within the two openings 24 and 26 by overlapping the top portions of the bags over the ribs. The bags are securely held in place by either the clamping channel 50 and funnel 60 (FIG. 3), or the table 74 (FIG. 4). The funnel 60 would be particularly useful when collecting large amounts of refuse such as, for example, raked leaves, grass clippings or conducting other yard work.

The table 74 provides for a quickly adaptable table top surface providing a broad, flat working surface on the table top 76 and also provides access to refuse collector bags through access doors 90 and 92.

The conversion between the use of funnel 60 (FIG. 3) and table 74 (FIG. 4) merely requires lifting the funnel 60 and clamping channel 50 off of the frame 10 and replacing the funnel 60 with table 74. The table 74 may be locked in position by inserting locking pins 87 as described above. To convert back to the use of the funnel 60, first, the locking pins are removed, then the table 74 is lifted off of the frame 10 and replaced with the funnel 60 and clamping channel 50.

The diverging leg structure of the present invention defines a substantially frusto-pyramidal structure which allows for easy access to and removal of the bags. The quick release supports 42 and 44 allow quick access to the bags contained within the interior of the frame 10 and the diverging of the legs limits the interference between the bag and the legs upon removal of the bag from the frame 10.

It will become readily apparent to those of ordinary skill in the art that various modifications may be made to the present invention without departing from the spirit and scope thereof. Such as, for example, the legs may be pivotably connected to the frame 10 to provide a collapsible frame 10. Consequently, the intended scope of the present invention is defined by the following claims.

I claim:

1. A portable, convertible collection device and work table combination comprising:

a frame including a plurality of ribs which define a substantially rectangular interior with two distinct openings defined within said rectangular interior, wherein each said opening is adapted to receive a bag which is supported by said ribs, a plurality of from said ribs adjacent a corner of said rectangular interior;

a removable table adapted to be supported on said ribs and to secure said bags supported by said ribs, said table including a substantially flat table top, and a plurality of positioning studs attached to a bottom surface of said table top and receivable in said rectangular interior to position said table on said ribs; and a removable funnel adapted to be supported on said ribs to direct material into and to secure said bags supported by said ribs, said funnel including a top funnel-shaped portion and a substantially rectangular base.

2. The combination of claim 1 wherein said plurality of ribs further include a pair of parallel, spaced central ribs which divide said rectangular interior into said two openings and a slot positioned between said central ribs.

3. The combination of claim 2 further including a generally U-shaped clamping channel engagable with said pair of central ribs to secure the bags supported by said ribs therebetween.

4. The combination of claim wherein said U-shaped clamping channel is formed integrally with said funnel.

5. The combination of claim 2 wherein said base includes at least one pair of central cutouts adapted to receive said central ribs wherein said funnel is supported by said ribs.

6. The combination of claim 5 wherein two pairs of central cutouts are provided on said base.

7. The combination of claim 5 wherein corner cutouts are provided in the corners of said base.

8. The combination of claim 5 wherein said base includes a plurality of projections which extend into the interior of the bags supported by said ribs.

9. The combination of claim 2 wherein said positioning studs include a central positioning stud which is receivable in said slot positioned between said central ribs.

10. The combination of claim 1 wherein at least one of said positioning studs includes a locking hole which aligns with a through-hole in one of said ribs, wherein said locking pin is engagable with both said locking hole and said through-hole to secure said table to said frame.

11. The combination of claim 10 wherein two said locking holes and cooperating through-holes and locking pins are provided.

12. The combination of claim 10 which further includes a means for attaching said locking pin to said ribs.

13. The combination of claim 12 wherein said means is a chain.

14. The combination of claim wherein said table includes at least one access door in said table top to provide access to one of said bags supported by said ribs.

15. The combination of claim 14 wherein two said access doors are provided in said table top.

16. The combination of claim 1 wherein said frame further includes supports extending between said legs.

17. The combination of claim 16 wherein two of said supports are removable.

18. The combination of claim 17 wherein said removable supports have notches which engage support pegs provided in said legs.

19. The combination of claim 1 wherein said table further includes a rim which extends above the peripheral edges of three sides of said table top.

20. The combination of claim 1 which further includes a means for easily collapsing said frame for storage or transportation.

21. The combination of claim 20 wherein said means further includes pivotally connecting said legs to said frame.

* * * * *

UNITED STATES PATENT AND TRADEMARK OFFICE

CERTIFICATE OF CORRECTION

PATENT NO. : 5,226,621

DATED : July 13, 1993

INVENTOR(S) : James Skoff

It is certified that error appears in the above-identified patent and that said Letters Patent is hereby corrected as shown below:

Column 1 Line 11 after "for" insert --example, as--.

Column 3 Line 9 "2" should read --28--.

Claim 1 Line 12 Column 4 after "of" insert --legs supporting said ribs, wherein each said leg extends--.

Claim 4 Line 36 Column 4 after "claim" insert --3--.

Claim 14 Line 66 Column 4 after "claim" insert --1--.

Signed and Sealed this

First Day of March, 1994

*Attest:*

Bruce Lehman

BRUCE LEHMAN

*Attesting Officer*

*Commissioner of Patents and Trademarks*